US005749578A

United States Patent [19]

Stacey

[11] Patent Number: 5,749,578

[45] Date of Patent: May 12, 1998

[54] COMBINATION LOTTO CHECKER AND SCRAPER

[76] Inventor: Karen Lynne Stacey, 1 West St., Farmingdale, N.Y. 11735

[21] Appl. No.: 851,579

[22] Filed: May 5, 1997

[51] Int. Cl.[6] ..... A47L 25/00; A63F 3/06

[52] U.S. Cl. ..... 273/148 R; 15/236.01

[58] Field of Search ..... 273/148 R, 269; 15/236.01, 105; 30/136, 169

[56] References Cited

U.S. PATENT DOCUMENTS

| | | | |
|---|---|---|---|
| 4,757,567 | 7/1988 | Booker | 273/148 R X |
| 4,793,061 | 12/1988 | Rizzo, Jr. | 273/148 R X |
| 4,881,291 | 11/1989 | Ellis | 273/148 R X |
| 5,007,642 | 4/1991 | Henry et al. | 273/148 R |
| 5,133,554 | 7/1992 | Piccinini, Sr. | 273/148 R |
| 5,154,422 | 10/1992 | Highsmith, Sr. et al. | 273/148 R |
| 5,158,294 | 10/1992 | Piro | 273/148 R |
| 5,507,492 | 4/1996 | Adell | 273/148 R X |

*Primary Examiner*—Raleigh W. Chiu
*Attorney, Agent, or Firm*—Michael I. Kroll

[57] ABSTRACT

A combination lotto checker and scraper (26) comprising a handle/blade (28) having a transverse slot (30) extending through opposite side edges (32) and (34) thereof and a top recessed surface (36) above the transverse slot (30). In a first instance, a person (38) can write with a writing instrument (40) winning numbers (42) within the top recessed surface (36), insert and slide a lotto ticket (44) through the transverse slot (30) to compare the winning numbers (42) with numbers (46) on the lotto ticket (44). In a second instance, the person (38) can use the side edges (32) and (34) of the handle/blade (28) to scratch off lottery cards (48) to see the numbers (50) thereon.

20 Claims, 7 Drawing Sheets

COMBINATION LOTTO CHECKER AND SCRAPER

BACKGROUND OF THE INVENTION

1. Field of the Invention

A lottery is a popular form of gambling in which the players pay to participate and the winners are determined by chance. It is also a method of selection, as in a lottery to choose which groups of men will be conscripted into the army. In most lotteries, players buy numbered tickets at fixed prices. At a subsequent drawing the winning numbers are picked at random by lot, or are selected on some other unpredictable basis, such as the results of a horse race.

Over the centuries, lotteries of various types have been organized for a variety of purposes and have realized huge sums for their promoters. Governments have frequently used lotteries as a source of revenue or as a supplement to, or substitute for, taxation. The earliest state lotteries were organized in France in 1520. In 1680, England held a historic lottery to raise funds for improving London's water supply equipment. Spain developed the gordo, and Ireland, the sweepstakes. Lotteries were popular in the United States, although dishonest practices in both private and public lotteries eventually forced the federal government to prohibit in 1890, the transportation of lottery tickets by mail or in interstate commerce. The states also took prohibitive action, and between the 1890's and 1963, no government sponsored lotteries were held in the United States.

In 1963, however, New Hampshire authorized a sweepstakes lottery and designated a proportion of the monies made to be spent on its education system. The lottery proved so profitable that, by the mid 1990's, about seventy percent of the states and the District of Columbia, had approved lotteries—among them, California, Massachusetts, New Jersey, New York, Pennsylvania, Texas and Georgia. The practice of the states is to reserve a certain percentage of the lottery take for expenses, a large percentage for the state itself, and a lesser percentage for prizes.

Lotteries have remained an important feature of life in other countries as well. In 1976, Canada sponsored a lottery to help pay for the Olympic Games in Montreal. By the time the games started, the lottery had netted an unexpected two hundred million. Today that country has a number of provincial and national lotteries. The Soviet Union introduced several national lotteries to help develop Soviet sports and to finance construction of facilities for the 1980 Olympic Games. In 1993, Britain approved a national lottery to benefit the arts, sports, heritage and charities.

The instant invention relates generally to lottery game equipment and more specifically it relates to a combination lotto checker and scraper. The combination lotto checker and scraper is a tool that will allow a person to compare winning numbers with numbers on a lotto ticket, as well as for scratching lottery cards to see the numbers thereon.

2. Description of the Prior Art

Numerous lottery game equipment have been provided in prior art that are adapted to assist people in randomly picking various numbers to play state operated lotto games. While these units may be suitable for the particular purpose to which they address, they would not be as suitable for the purposes of the present invention as heretofore described.

SUMMARY OF THE INVENTION

A primary object of the present invention is to provide a combination lotto checker and scraper that will overcome the shortcomings of the prior art devices.

Another object is to provide a combination lotto checker and scraper with a personalized logo in a display case, having a tapered handle/blade that can be utilized for scratching lottery cards to see the numbers thereon.

An additional object is to provide a combination lotto checker and scraper with a top recessed window in the tapered handle/blade, so that a person can write winning numbers therein, to compare the winning numbers with numbers on a lotto ticket that is transversely inserted into a slot in the handle/blade.

A further object is to provide a combination lotto checker and scraper that is simple and easy to use.

A still further object is to provide a combination lotto checker and scraper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the instant invention, showing a person writing winning numbers into a recessed window on the handle/blade.

FIG. 1*a* is a perspective view of the instant invention, showing the lotto ticket inserted through the slot in the handle/blade.

FIG. 1*b* is a perspective view of the instant invention, showing a person scraping off a lottery card to see the numbers thereon.

FIG. 2 is an enlarged perspective view of an area of FIG. 1*b* as indicated by arrow 2 in FIG. 1*b*, with parts broken away and in section.

FIG. 2*a* is a side view taken in the direction of arrow 2*a* in FIG. 1.

Similar reference characters denote corresponding features consistently throughout the attached drawings.

DETAILED DESCRIPTION OF THE PREFERRED EMBODIMENTS

Figure 1:
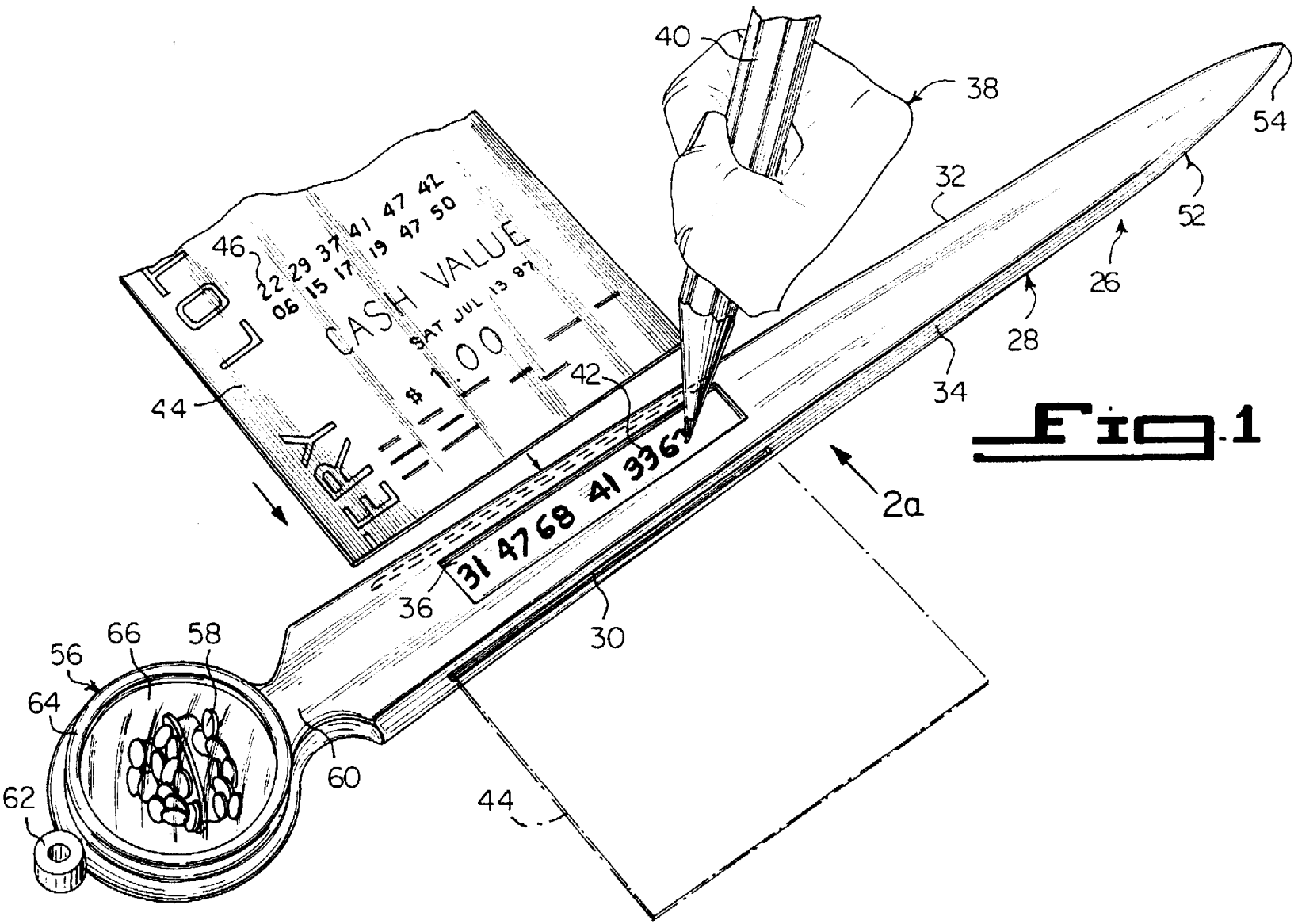
Figure 1A:
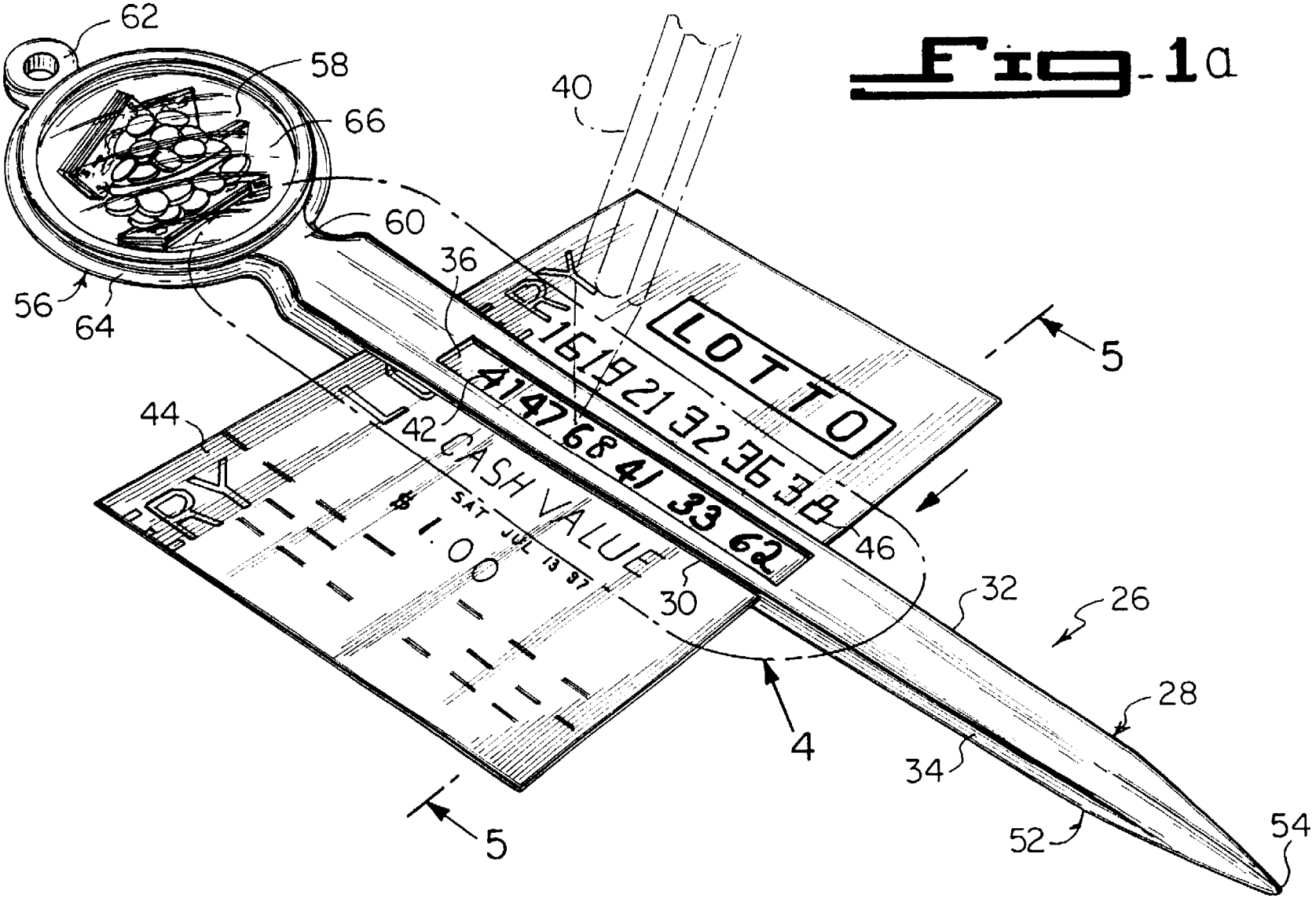
Figure 1B:
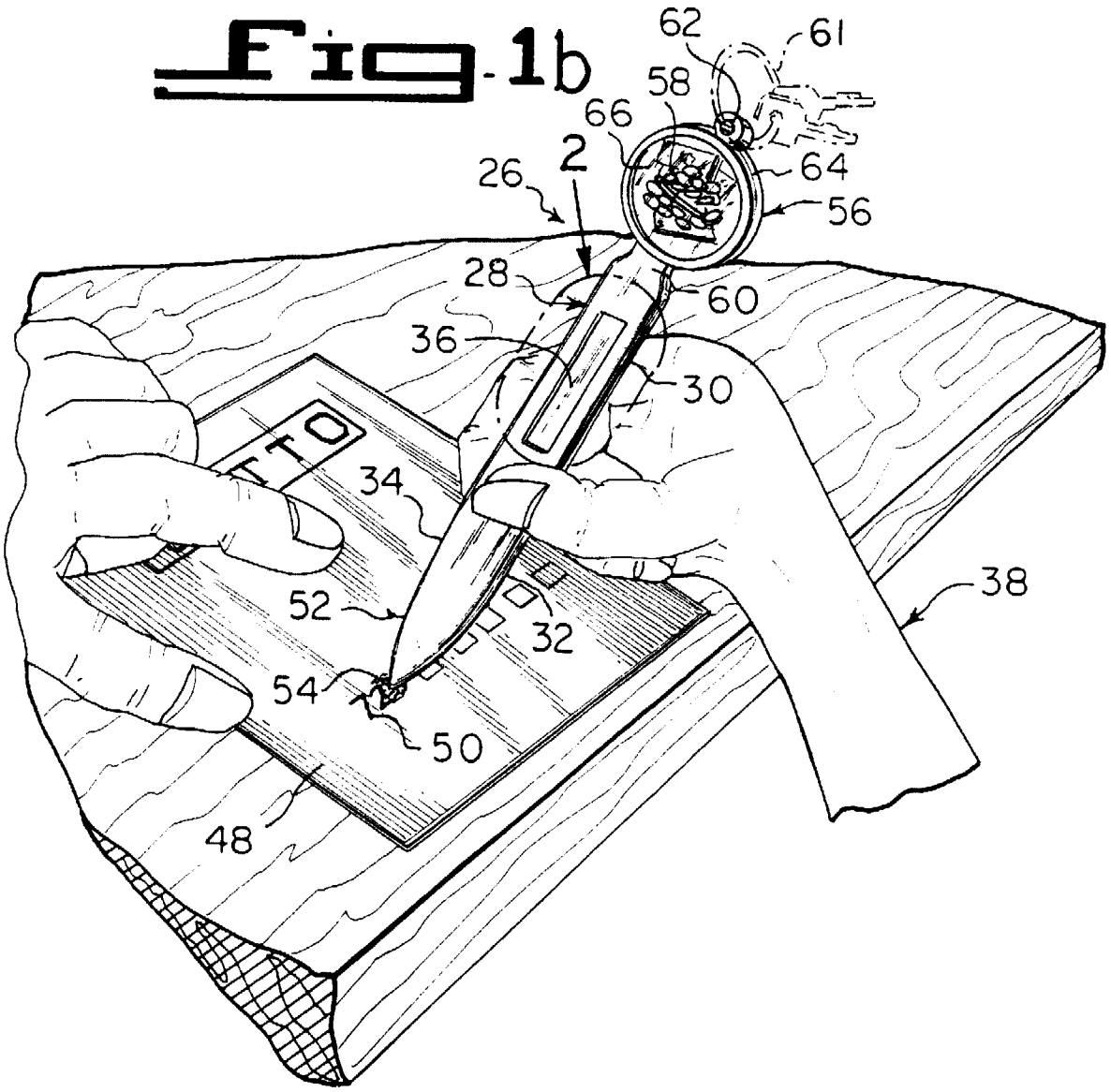
Figure 2:
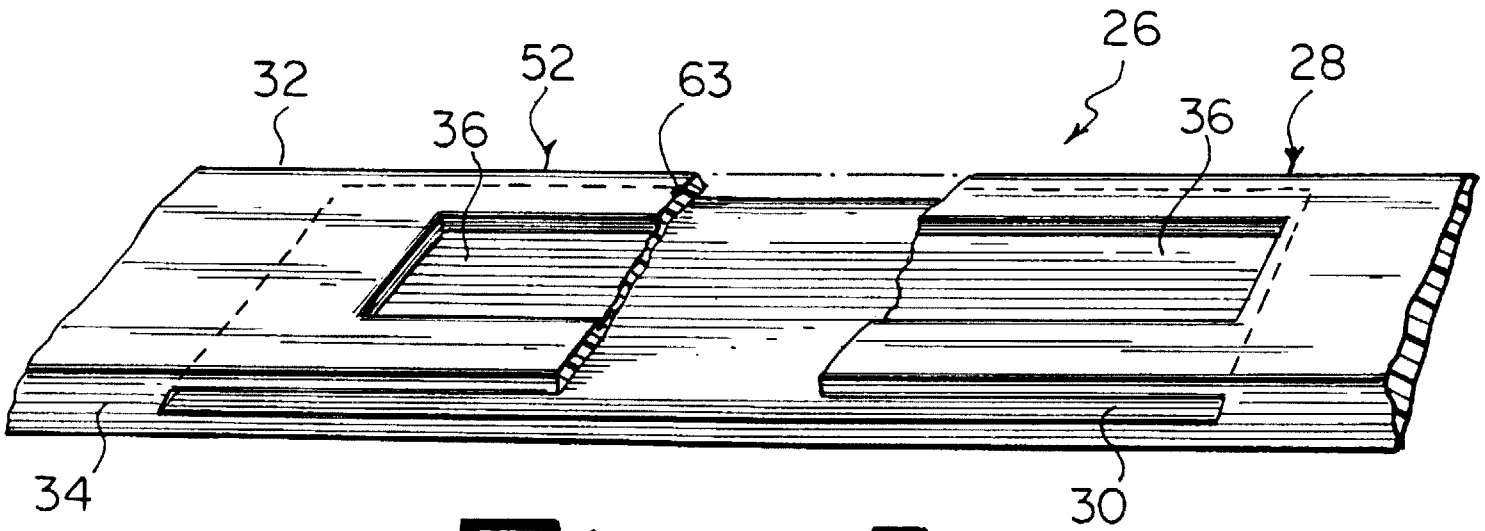
Figure 2A:
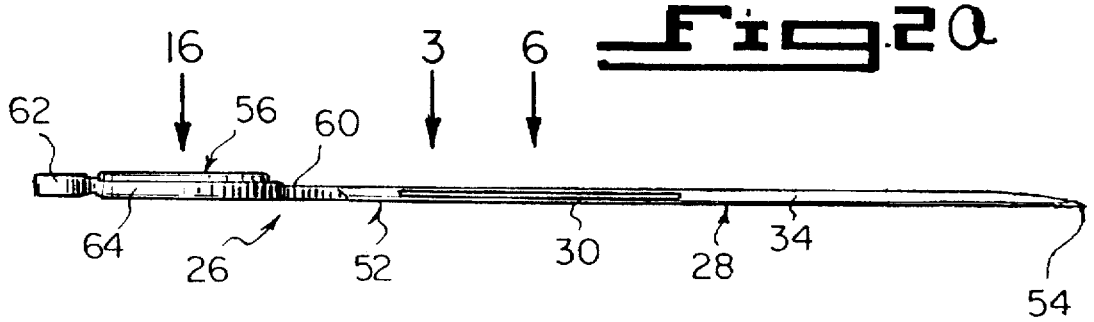

Turning now descriptively to the drawings, in which similar reference characters denote similar elements throughout the several views, FIGS. 1 to 25 illustrate a combination lotto checker and scraper 26 comprising a handle/blade 28 having a transverse slot 30 extending through opposite side edges 32 and 34 thereof, and a top recessed surface 36 above the transverse slot 30. In a first instance, as shown in FIGS. 1 and 1*a*, a person 38 can write with a writing instrument 40 winning numbers 42 within the top recessed surface 36, insert and slide a lotto ticket 44 through the transverse slot 30, to compare the winning numbers 42 with numbers 46 on the lotto ticket 44. In a second instance, as shown in FIG. 1*b*, the person 38 can use the side edges 32 and 34 of the handle/blade 28 to scratch off lottery cards 48, to see the numbers 50 thereon.

The handle/blade 28 is an elongated tapered flat shank 52 having a pointed tip 54, while the side edges 32 and 34 are beveled. The combination lotto checker and scraper 26 further includes a display case 56. A personalized logo 58 is carried within the display case 56. A tang 60 is between a first side of the display case 56 and the handle/blade 28.

A loop 62 is on a second side of the display case 56 opposite from the tang 60. The loop 62 can be used to hang up the combination lotto checker and scraper 26 when not in use and engage with a key ring 61, as shown in phantom in FIG. 1*b*. The handle/blade 28, the display case 56, the tang 60 and the loop 62 are all integral with each other to form a complete uniform tool.

The complete uniform tool is fabricated out of a strong durable material 63, such as plastic, metal or wood. The display case 56 consists of a frame 64 and a transparent face 66 within the frame 64.

The personalized logo 58 can be a picture to represent a holiday, as shown in FIGS. 6 to 12. The personalized logo 58 can be a picture to represent a profession, as shown in FIG. 13. The personalized logo 58 can be a picture to represent a sport, as shown in FIG. 14. The personalized logo 58 can be a picture to represent a horoscope, as shown in FIGS. 15 to 26.

Other logos 58, as shown in FIGS. 1, 1*a*, 1*b*, 3 and 4, can also be a picture to represent other special occasions, novelty ideas, hobbies, birthstones, nationalities and religious symbols. The combination lotto checker and scraper 26 can come in different colors to accommodate various horoscopes, gemstones and birthstones.

Figure 3:
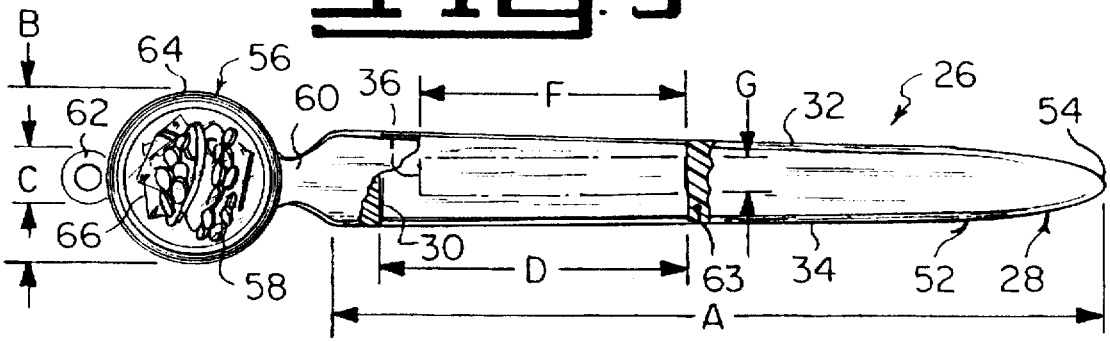
FIG. 3 is a top view taken in the direction of arrow 3 in FIG. 2*a*, with parts broken away and in section.

The sizes of the various parts of the combination lotto checker and scraper 26, as shown in FIG. 3, can be typically, but not limited to, the following dimensions:

A) Length of the handle/blade 28 is six inches.

B) Diameter of the display case 56 is one inch.

C) Diameter of the loop 62 is one quarter of an inch.

D) Length of the transverse slot 30 is three and one quarter inches.

Figure 4:
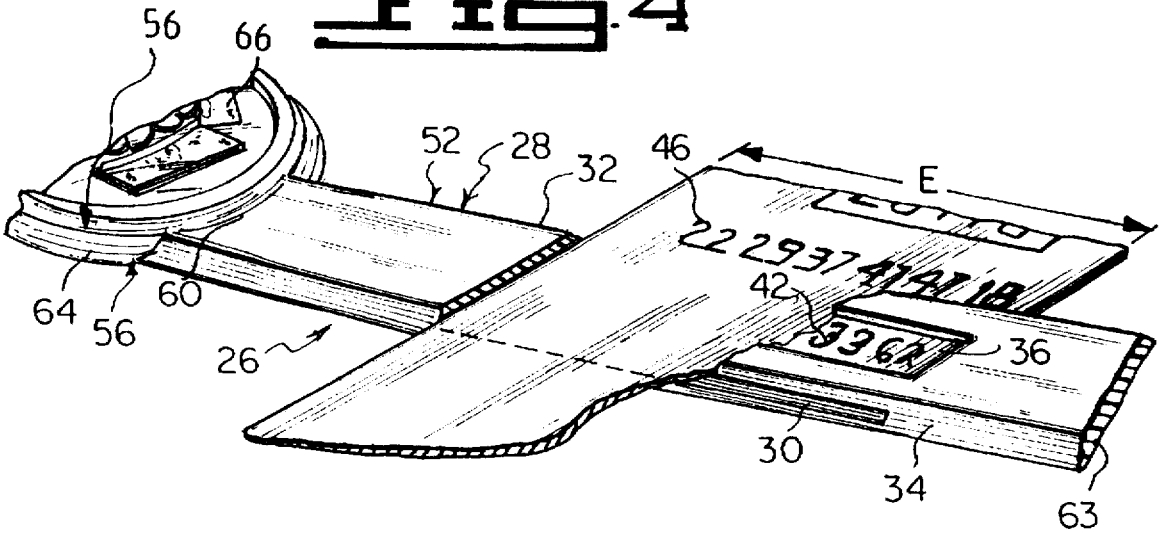
FIG. 4 is an enlarged perspective view of an area of FIG. 1*a* as indicated by arrow 4, with parts broken away and in section.
Figure 5:
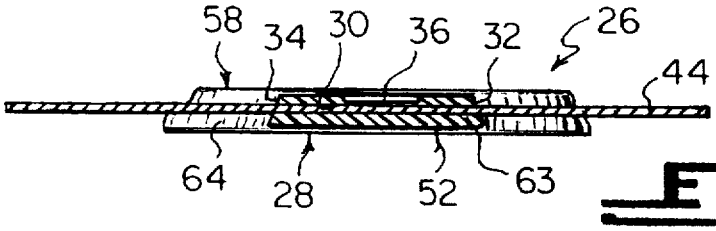
FIG. 5 is a cross sectional view taken along line 5—5 in FIG. 1*a*.
Figures 6, 7, 8, 9, 10:
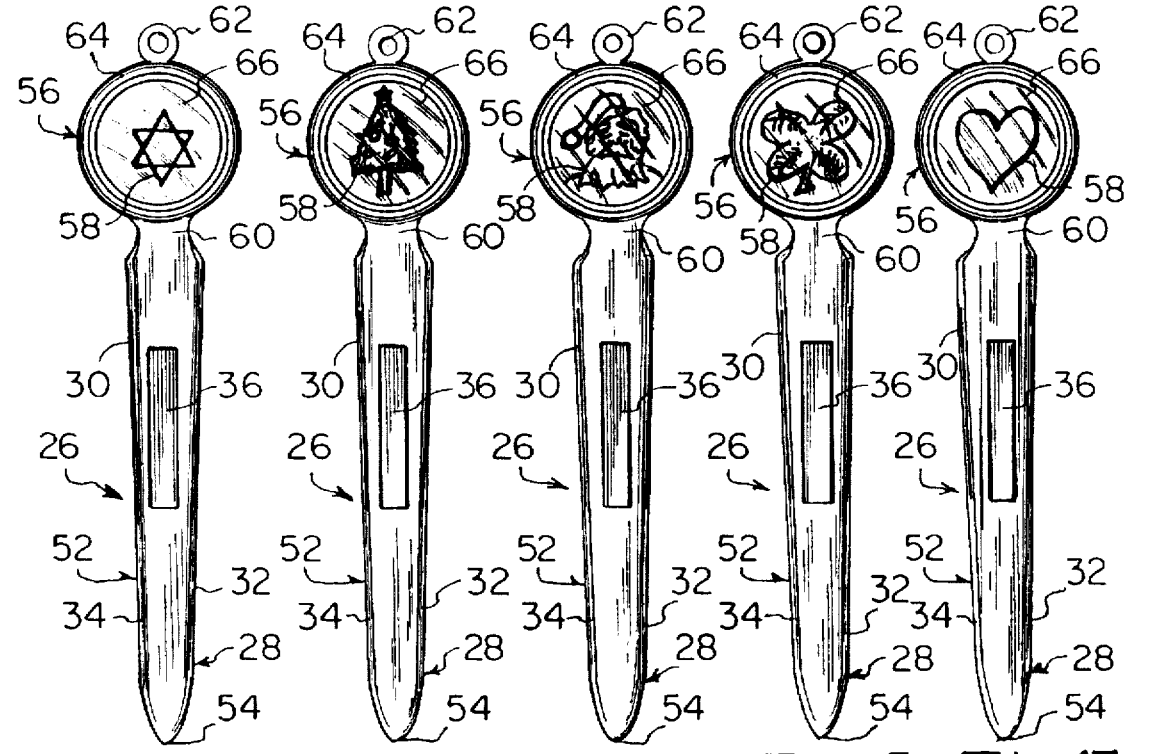
FIGS. 6 to 15 are top views taken in the direction of arrow 6 in FIG. 2*a*, showing different logos in the display cases.
Figures 11, 12, 13, 14, 15:
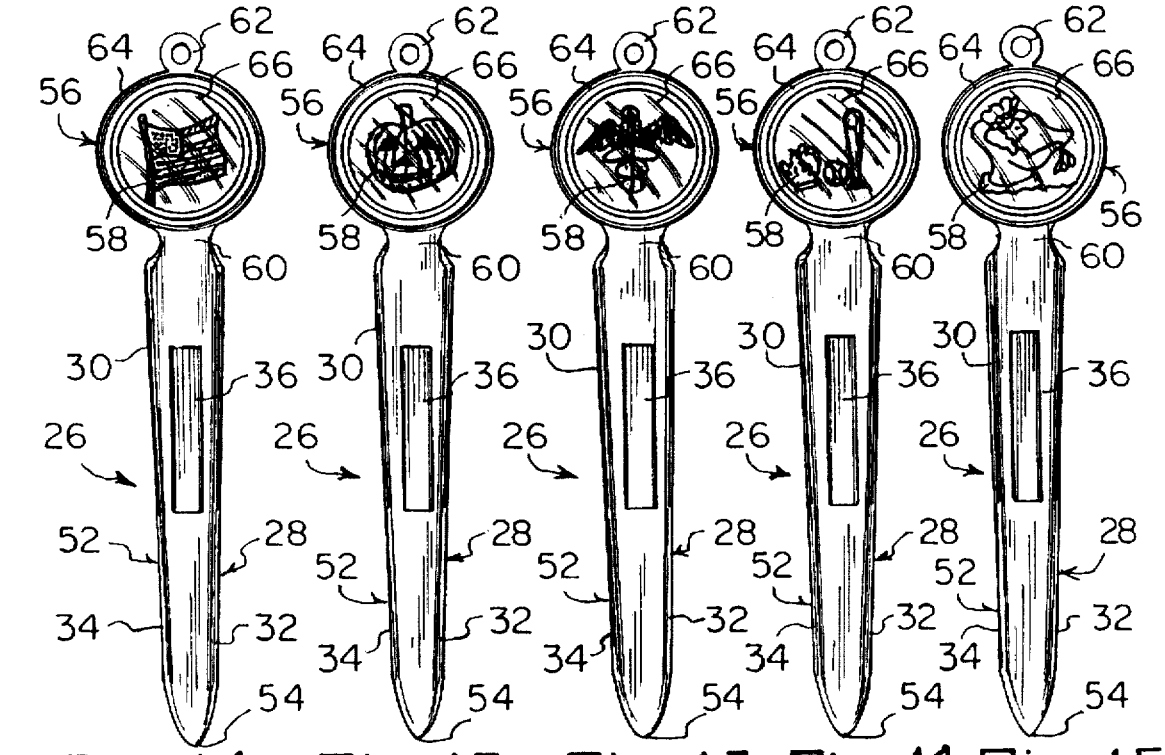
Figure 16:
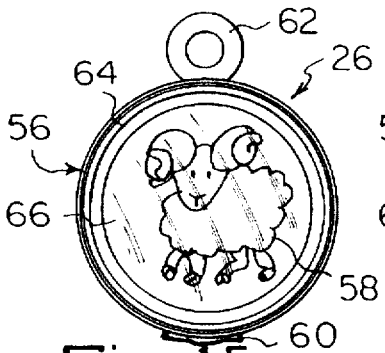
FIGS. 16 to 26 are top views taken in the direction of arrow 16 in FIG. 2*a*, with the handle/blades broken away, showing different logos of the Zodiac in the display cases.
Figure 17:
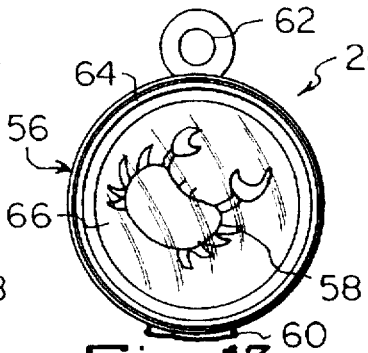
Figure 18:
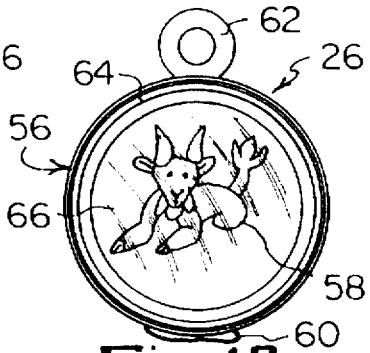
Figure 19:
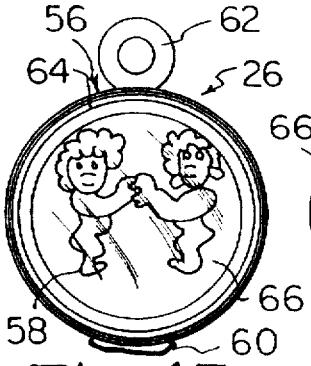
Figure 20:
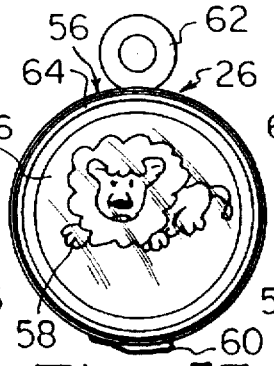
Figure 21:
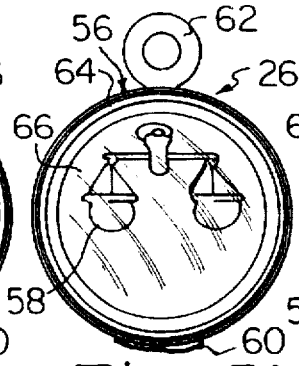
Figure 22:
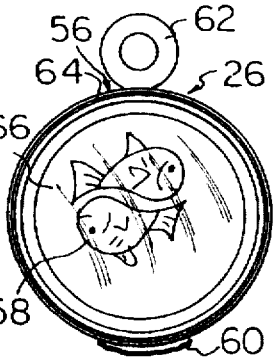
Figure 23:
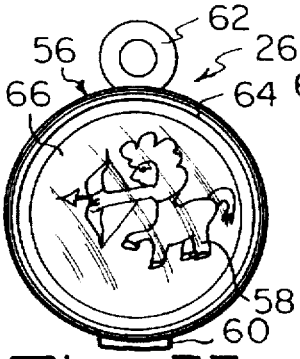
Figure 24:
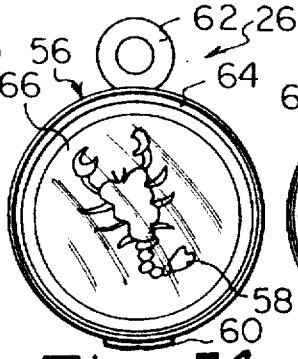
Figure 25:
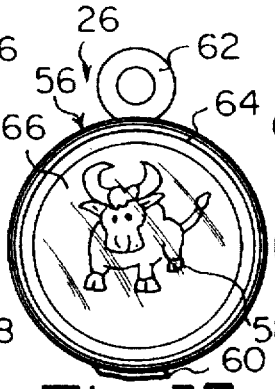
Figure 26:
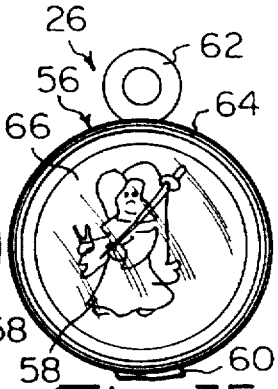

E) The width of the lotto ticket 44, as shown in FIG. 4, is three and one quarter inches. If the lotto ticket 44 is wider than that of the transverse slot 30, it can be folded over lengthwise to fit within the transverse slot 30.

F) Length of the top recessed surface 36 is two inches.

G) Width of the top recessed surface 36 is one quarter of an inch.

LIST OF REFERENCE NUMBERS

26 combination lotto checker and scraper

28 handle/blade

30 transverse slot in 28

32 side edge of 28

34 side edge of 28

36 top recessed surface in 28

38 person

40 writing instrument

42 winning number

44 lotto ticket

46 number on 44

48 lottery cards

50 number on 48

52 elongated tapered flat shank for 28

54 pointed tip on 52

56 display case of 26

58 personalized logo in 56

60 tang between 56 and 28

61 key ring

62 loop on 56

63 strong durable material for 28

64 frame of 56

66 transparent face of 56 in 64

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination lotto checker and scraper comprising a handle/blade having a transverse slot extending through opposite side edges thereof and a top recessed surface above said transverse slot, so that in a first instance a person can write with a writing instrument winning numbers within said top recessed surface and insert and slide a lotto ticket through said transverse slot to compare the winning numbers with numbers on the lotto ticket, while in a second instance the person can use said side edges of said handle/blade to scratch off lottery cards to see the numbers thereon.

2. A combination lotto checker and scraper as recited in claim 1, wherein said handle/blade is an elongated tapered flat shank having a pointed tip, while said side edges are beveled.

3. A combination lotto checker and scraper as recited in claim 1, further including:

a) a display case;

b) a personalized logo carried within said display case; and c) a tang between a first side of said display case and said handle/blade.

4. A combination lotto checker and scraper as recited in claim 3, further including a loop on a second side of said display case opposite from said tang, so that said loop can be used to hang up said combination lotto checker and scraper when not in use and engage with a key ring.

5. A combination lotto checker and scraper as recited in claim 4, wherein said handle/blade, said display case, said tang and said loop are all integral with each other to form a complete uniform tool.

6. A combination lotto checker and scraper as recited in claim 5, wherein said complete uniform tool is fabricated out of a strong durable material, selected from a group consisting of plastic, metal and wood.

7. A combination lotto checker and scraper as recited in claim 3, wherein said display case includes:

a) a frame; and b) a transparent face within said frame.

8. A combination lotto checker and scraper as recited in claim 3, wherein said personalized logo can be a picture to represent a holiday.

9. A combination lotto checker and scraper as recited in claim 3, wherein said personalized logo can be a picture to represent a profession.

10. A combination lotto checker and scraper as recited in claim 3, wherein said personalized logo can be a picture to represent a sport.

11. A combination lotto checker and scraper as recited in claim 3, wherein said personalized logo can be a picture to represent a horoscope.

12. A combination lotto checker and scraper comprising:

a) a handle/blade having a transverse slot extending through opposite side edges thereof and a top recessed surface above said transverse slot, so that in a first instance a person can write with a writing instrument winning numbers within said top recessed surface and insert and slide a lotto ticket through said transverse slot to compare the winning numbers with numbers on the lotto ticket, while in a second instance the person can use said side edges of said handle/blade to scratch off lottery cards to see the numbers thereon;

b) a display case;

c) a personalized logo carried within said display case;

d) a tang between a first side of said display case and said handle/blade; and e) a loop on a second side of said display case opposite from said tang, so that said loop can be used to hang up said combination lotto checker and scraper when not in use and engage with a key ring.

13. A combination lotto checker and scraper as recited in claim 12, wherein said handle/blade is an elongated tapered flat shank having a pointed tip, while said side edges are beveled.

14. A combination lotto checker and scraper as recited in claim 13, wherein said handle/blade, said display case, said tang and said loop are all integral with each other to form a complete uniform tool.

15. A combination lotto checker and scraper as recited in claim 14, wherein said complete uniform tool is fabricated out of a strong durable material, selected from a group consisting of plastic, metal and wood.

16. A combination lotto checker and scraper as recited in claim 15, wherein said display case includes:

a) a frame; and b) a transparent face within said frame.

17. A combination lotto checker and scraper as recited in claim 16, wherein said personalized logo can be a picture to represent a holiday.

18. A combination lotto checker and scraper as recited in claim 16, wherein said personalized logo can be a picture to represent a profession.

19. A combination lotto checker and scraper as recited in claim 16, wherein said personalized logo can be a picture to represent a sport.

20. A combination lotto checker and scraper as recited in claim 16, wherein said personalized logo can be a picture to represent a horoscope.

* * * * *